US008151893B2

(12) United States Patent
Nold et al.

(10) Patent No.: US 8,151,893 B2
(45) Date of Patent: Apr. 10, 2012

(54) SLEEVE ASSEMBLY FOR DOWNHOLE TOOLS

(75) Inventors: Raymond V. Nold, Beasley, TX (US); David Kempher, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 227 days.

(21) Appl. No.: 12/638,074

(22) Filed: Dec. 15, 2009

(65) Prior Publication Data

US 2011/0139438 A1 Jun. 16, 2011

(51) Int. Cl.
*E21B 17/10* (2006.01)

(52) U.S. Cl. ..... 166/380; 166/241.5; 166/378; 166/385

(58) Field of Classification Search ..... 166/377, 166/378, 241.5, 241.6, 380, 385, 227, 235, 166/236, 157, 158; 175/59, 244, 309, 40
See application file for complete search history.

(56) References Cited

U.S. PATENT DOCUMENTS 3,033,289 A * 5/1962 Moore ..... 166/115
3,965,978 A * 6/1976 Conley et al. ..... 166/113
6,092,416 A 7/2000 Halford et al.

* cited by examiner

*Primary Examiner* — Brad Harcourt
(74) *Attorney, Agent, or Firm* — David Hofman; Michael L. Flynn; Jody Lynn DeStefanis

(57) ABSTRACT

An example method comprises securing a sleeve around at least a portion of a downhole tool, deploying the sleeve and the downhole tool into a wellbore penetrating a subterranean formation, and retrieving the sleeve and the downhole tool from the wellbore. The step of securing the sleeve around the at least portion of the downhole tool may be performed at the well site.

43 Claims, 12 Drawing Sheets

SLEEVE ASSEMBLY FOR DOWNHOLE TOOLS

BACKGROUND OF THE DISCLOSURE

Downhole tools, such as wireline well logging instruments, are routinely deployed in wellbores penetrating subterranean formation. Examples of deployment systems may be found in "*Advancing Downhole Conveyance*" by M. Alden, F. Arif, M. Billingham, N. Grønnerød, S. Harvey, M. E. Richards, and C. West, in Oilfield Review, 16, no. 3 (Autumn 2004), pp 30-43.

In some cases, it may be advantageous to provide a drilling fluid circulation path around one or more downhole tools. The circulation path may be provided using a sleeve, for example as shown in PCT Patent Application. Pub. No. WO 2008/100156, the disclosure of which is incorporated herein by reference.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
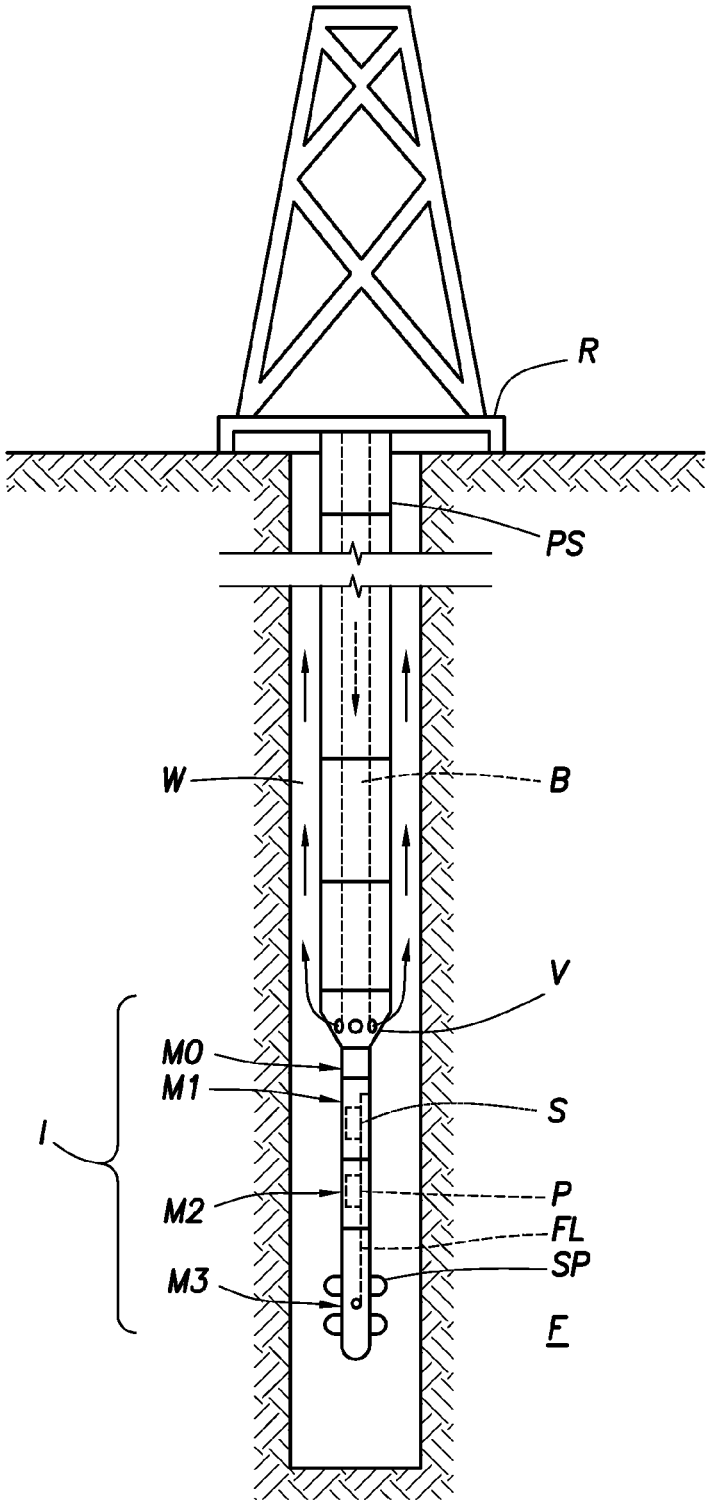
FIG. 1 (PRIOR ART)
FIG. 1 is a schematic view of a prior art apparatus.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to sleeve assemblies that may be readily mounted over at least a portion of a downhole tool, such as a portion of a wireline well logging instrument comprising a plurality of modules. The sleeve assembly may be configured to form a flow passage between a downhole tool outer surface and the sleeve assembly. Drilling fluid may be provided downhole via a bore in a pipe string suspended in a wellbore penetrating a subterranean formation. The drilling fluid may be circulated at least partially in the flow passage formed between the downhole tool outer surface and the sleeve assembly, and in an annulus between the sleeve assembly and a wellbore wall. The drilling fluid circulation in the flow passage formed between the downhole tool outer surface and the sleeve assembly may be used to dissipate heat generated by the one or more components (e.g., modules) of the tool, thereby increasing the temperature range at which the one or more components of the downhole tool may be operated. Further, the drilling fluid circulation in the annulus between the sleeve assembly and a wellbore wall may reduce the risk of differential sticking between portions of downhole tool and/or of the sleeve assembly and the wellbore wall, thereby increasing the duration during which the downhole tool may remain stationary and perform formation evaluation. Still further, the sleeve assembly may be used to limit the exposure of the wellbore wall to normal flow of drilling fluid, thereby reducing the erosion of the wellbore wall caused by mud circulation.

FIG. 1 shows a well site in which the sleeve assemblies of the present disclosure (not shown) may be used. It should be noted however that the sleeve assemblies of the present disclosure may alternatively be used in association with other well site configurations. The well site may comprise a pipe string PS, suspended from a rig assembly R into a wellbore W extending through a subterranean formation F. Drilling fluid may be pumped into a bore B or other types of drilling fluid passageway provided along the pipe string PS. The drilling fluid may be discharged into the wellbore W at vents V. The drilling fluid may then flow back towards the rig R, be reconditioned, and be pumped back into the bore B of the pipe string PS.

A well logging instrument I may be lowered in the wellbore W at a distal end of a pipe string PS. The well logging instrument I may comprise a plurality of modules M0, M1, M2 and M3. The modules M1, M2, and M3 may be similar to modules of a type usually used in wireline operation.

The module M0 may comprise a circulation sub configured to connect the modules M1, M2 and M3 to the distal end on the drill string PS. For example, the module M0 may be provided with the circulation vents V configured to discharge at least a portion of the drilling fluid circulating in the bore B of the pipe string PS to the annulus of the wellbore W. The module M0 may further be configured to electrically couple the modules M1, M2 and/or M3 of the well logging instrument I with a wireline cable (no shown). The module M3 may comprise a formation tester configured to establish a fluid communication with the formation F. For example, the module M3 may comprise a straddle packer SP configured to isolate an interval of the wellbore W around an inlet of a flow line FL. The module M2 may comprise a pressure gauge P configured to sense the pressure of the fluid in the flow line FL. For example, the pressure gauge P may be used to measure formation fluid pressure. The module M1 may comprise a pump S configured to controllably flow fluid in the flow line FL. For example, the pump S may be used to withdrawn fluid from the formation F and/or to perform formation transient testing. The fluid pumped from the formation may be discharged into the wellbore W, or may be retained in one of more sample chambers (not shown) configured to retain a sample of the fluid pumped from the formation. Alternatively, the pumped fluid may be retained in the bore B, for example as described in U.S. Pat. No. 6,092,416, the disclosure of which is incorporated herein by reference. Additional or alternative modules may be provided in the well instrument I, such as fluid analyzers, sidewall coring tools, etc.

Figure 2:
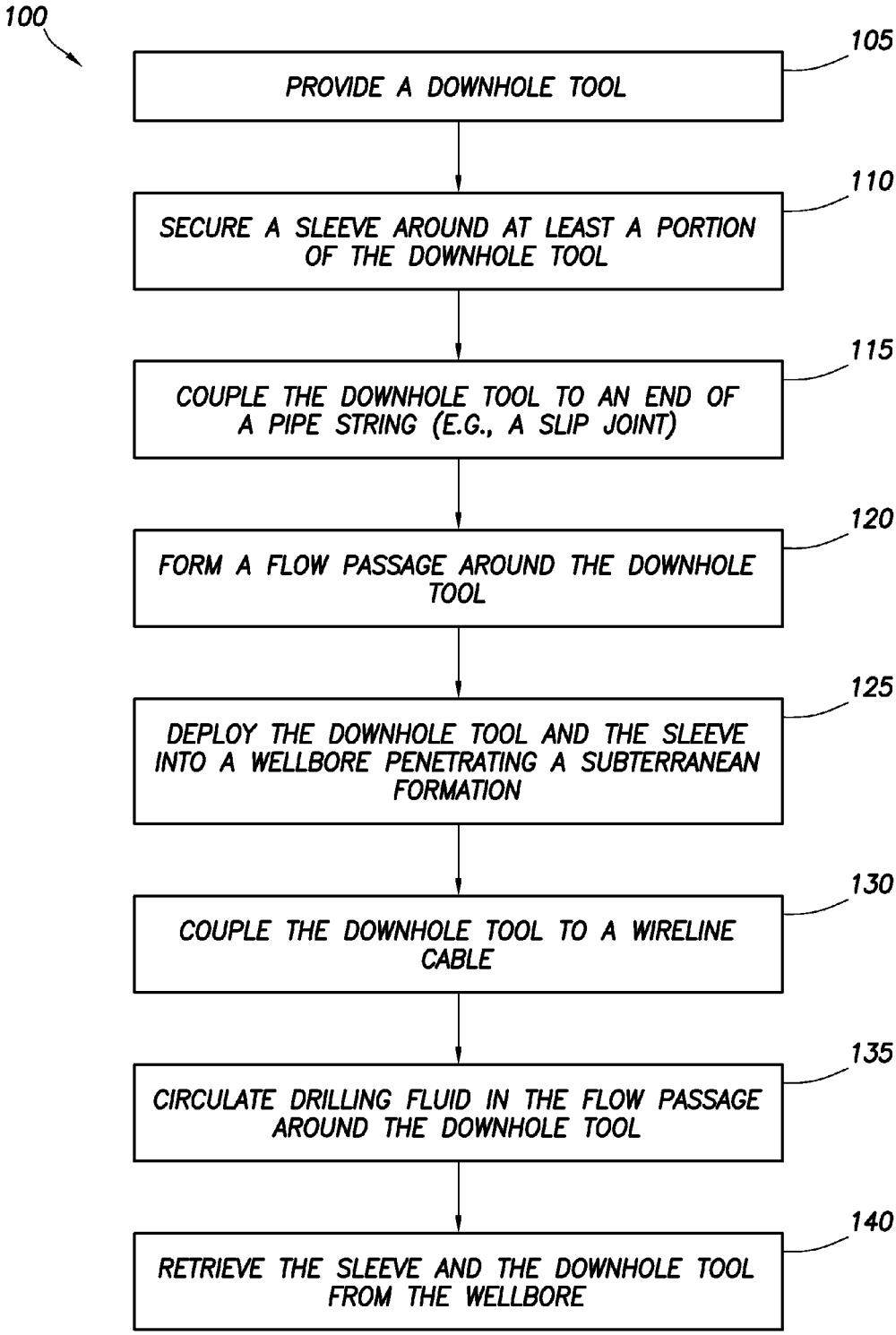
FIG. 2 is a flow-chart diagram of at least a portion of a method according to one or more aspects of the present disclosure.

As discussed previously, it may be advantageous to provide at least a portion of the well logging instrument I shown in FIG. 1 with a sleeve assembly. FIG. 2 shows a method 100 of deploying a downhole tool (e.g., a modular wireline well logging instrument) and a sleeve assembly into a wellbore penetrating a subterranean formation. It should be appreciated that the order of execution of the steps depicted in the flow chart of FIG. 2 may be changed and/or some of the steps described may be combined, divided, rearranged, omitted, eliminated, repeated and/or implemented in other ways.

Figure 3A:
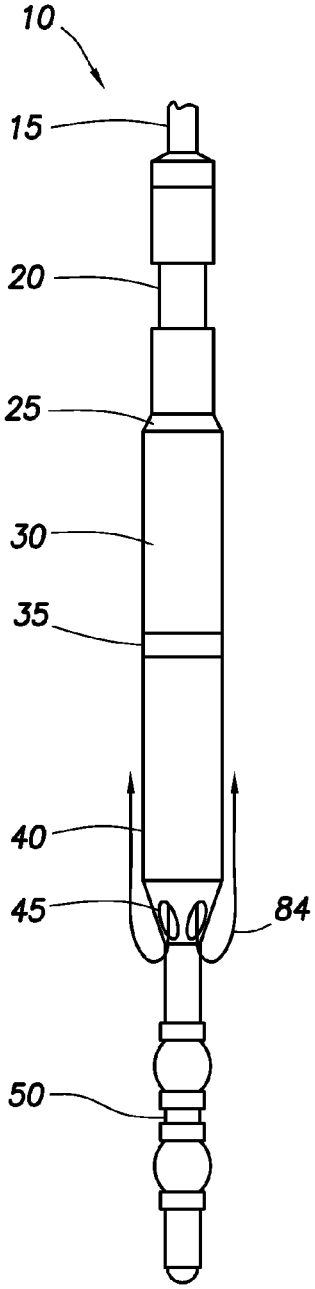
FIG. 3A is a front view of an apparatus according to one or more aspects of the present disclosure.
Figure 3B:
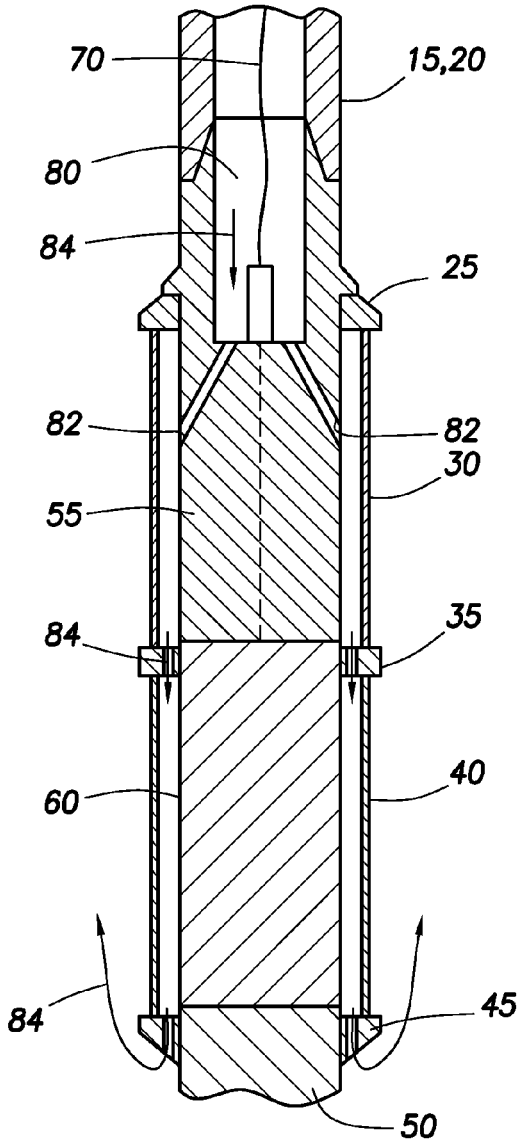
FIG. 3B is a sectional view of a portion the apparatus shown in FIG. 3A.

The method 100 may be performed, for example, using the well logging instrument 10 shown in FIGS. 3A, and 3B. Referring collectively to FIGS. 2, 3A, and 3B, a downhole tool, for example the well logging instrument 10, may be provided at step 105. The downhole tool may comprise a plurality of modules, for example the module 55 (e.g., a circulation sub similar to the module M0 in FIG. 1), the module 60 (e.g., a pump module similar to the module M1 in FIG. 1), and the module 50 (e.g., a formation tester similar to the module M3 in FIG. 1). For example, the modules 50 and/or 60 may be similar to modules of a type usually used in wireline operation. While three modules are depicted in FIGS. 3A and 3B, the downhole tool may comprise any number of modules without departing from the scope of the present disclosure.

A sleeve may be secured around at least a portion of the downhole tool at step 110. The sleeve may comprise a plurality of segments, for examples sleeve segments 30 and 40. While two contiguous sleeve segments 30 and 40 are depicted in FIGS. 3A and 3B, other sleeve configurations may be provided within the scope of the present disclosure, including sleeve configurations with more than or less than two segments, and/or non contiguous sleeve segments. Securing the sleeve around the at least portion of the downhole tool at step 110 may comprise interposing or juxtaposing the sleeve segments 30 and/or 40 between sleeve securing devices, such as rings 25, 35, and/or 45. Securing the sleeve around the at least portion of the downhole tool may also comprise engaging or coupling the sleeve securing devices (e.g., the rings 25, 35, and/or 45) to an outer surface of the downhole tool, for example an outer surface of the well logging instrument 10. Securing the sleeve around the at least portion of the downhole tool may also comprise engaging or coupling the sleeve securing devices (e.g., the rings 25, 35, and/or 45) to portions the sleeve segments 30 and/or 40. For example, the rings 25, 35, and/or 45 may comprise split collars, threaded rings, spacing and bracing ring assemblies, as further described herein. It should be noted that one or more of the rings 25, 35, and/or 45 may be omitted.

At step 115, the downhole tool may be coupled to an end of a pipe string, such as a bottom end of the pipe string 15. For example, a pin portion of a threaded connection provided with the module 55 may be tight to a box portion of the threaded connection provided with the pipe string 15. Optionally, additional components, such as a compensated slip-joint 20, may be inserted between the bottom end of the pipe string 15 and the downhole tool.

A flow passage may be formed around the downhole tool at step 120, as depicted for example by the arrows 84. The flow passage may be configured to provide a fluid communication between a bore 80 in the pipe string 15 and/or in the slip-joint 20 and at least a portion of the downhole tool outer surface. The flow passage may be provided with a combination comprising circulation vents 82 in the module 55, one or more apertures provided in the rings 35 and/or 45, and a gap between an outer surface of the modules 55 and/or 60 of the well logging instrument 10 and the sleeve segments 30 and/or 40 of the sleeve assembly.

The downhole tool and the sleeve may be deployed into a wellbore penetrating a subterranean formation at step 125. For example, the downhole tool may be deployed by adding stands to the pipe string 15 until the downhole tool reaches a formation to be evaluated. The downhole tool may be coupled to a wireline cable 70 at step 130. For example, a logging head may be pumped down to the tool string 15 and may be latched to a wet connect, thereby establishing an electrical communication between the modules 40 and/or 50 of the well logging instrument 10 and a logging unit (not shown) at the Earth's surface.

At step 135, drilling fluid may be circulated in the flow passage formed around the tool at step 120. For example, drilling fluid may be provided downhole to the bore 80 in the pipe string 15 and/or in the slip-joint 20 similarly to the description of FIG. 1. The drilling fluid circulation in the flow passage may be used to dissipate heat generated by the one or more components of the well logging instrument 10, such as pumps, motors, power electronic boards, among other components. Further, the drilling fluid circulation in the annulus between the sleeve assembly and a wellbore wall may reduce the risk of differential sticking between the modules 50, 55 and/or 60 of the well logging instrument 10 and/or the sleeve segments 30 and/or 40 and the wellbore wall. Still further, the sleeve segments 30 and/or 40 and the aperture in the ring 45 may be configured to deflect the flow of drilling mud escaping the vents 82 that would otherwise impinge on the wellbore wall. Thus, wellbore wall erosion may be reduced. Formation evaluation, such as formation transient testing, may also be performed at step 135. At step 140, the sleeve and the downhole tool may be retrieved from the wellbore.

Figure 4C:
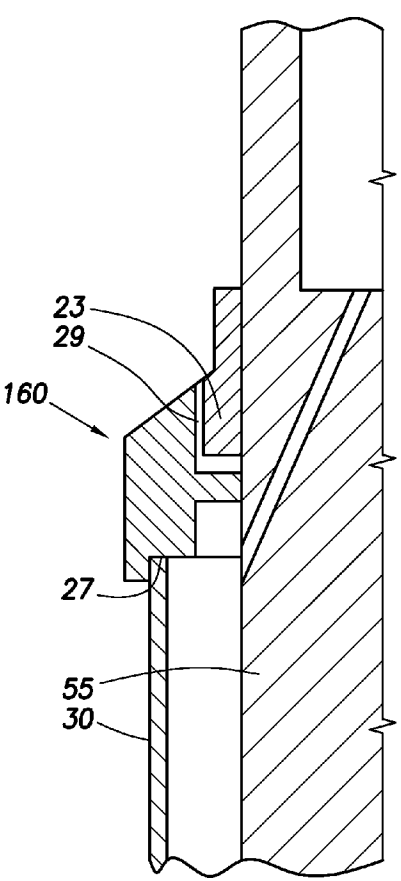
FIGS. 4A-4C are sectional views of apparatus according to one or more aspects of the present disclosure.
Figure 4B:
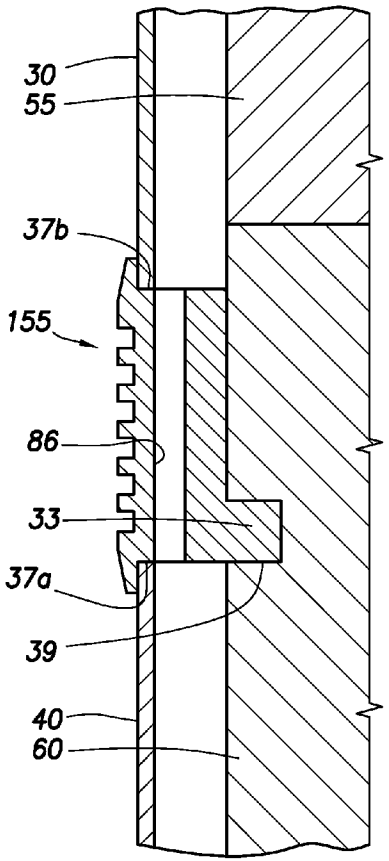
Figure 4A:
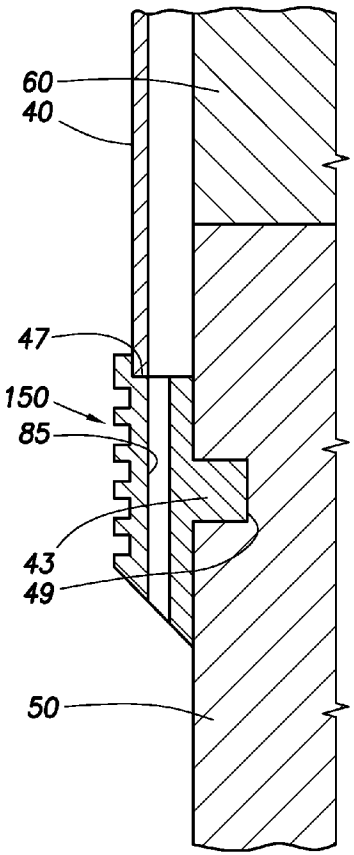

FIGS. 4A-4C show half sectional views of sleeve securing devices according to one or more aspects of the present disclosure. The securing devices may comprise bottom, middle, and top split collars, respectively 150, 155 and 160. The split collars 150, 155 and/or 160 may be used to implement the rings 45, 35 and/or 25 shown in FIGS. 3A and 3B. The split collars 150, 155 and/or 160 may also be utilized to perform the step 110 of the method 100 shown in FIG. 2. For example, the sleeve segment 30 and/or 40 may be interposed between the split collars 150, 155 and/or 160.

Each of the split collars 150, 155, 160 may comprise two halves (not shown) configured to be mounted on an outer surface of the body of a downhole tool (e.g., a body of the well logging instrument 10 shown in FIGS. 3A-3B and/or a body of the modules 50, 60, and/or 55). Two corresponding halves of one of the split collars 150, 155, 160 may be clenched on the outer surface of the body of the downhole tool using a plurality of transverse bolts (not shown), among other assembly devices.

The split collars, such as the bottom and middle split collars 150 and 155, may comprise a projecting strip or tongue (respectively 43 and 33) configured to engage a corresponding slot (respectively 49 and 39) provided on the outer surface of the body of the downhole tool (e.g., the body of the well logging instrument 10 shown in FIGS. 3A-3B, and/or the body of the modules 50 and 60). For example, the slot 49 and/or 39 may be provided with a vertical makeup groove usually utilized to hang wireline modules at the top of the well with a vertical makeup plate. The slot 49 and/or 39 may span over the entire perimeter of the body of the modules 50 and 60, or over a portion thereof.

Alternatively, the split collars, such as the top split collar 160, may comprise a slot, such as the slot 29, configured to engage a corresponding projecting strip or tongue provided on the outer surface of the body of a downhole tool (e.g., the body of the well logging instrument 10 shown in FIGS. 3A-3B, and/or the body of the module 55). The projecting strip may be integral with the body of the downhole tool, or may be provided with a clamp, such as the clamp 23, affixed to the body of the downhole tool. The clamp 23 may optionally comprise a threaded pin connection (not shown) configured to engage a corresponding box connection of a pipe string or of a slip-joint (e.g., the pipe string 15 or the slip-joint 20 of FIGS. 3A and 3B).

The split collars 150, 155, and/or 160 may comprise shoulders (e.g., shoulders 47, 37*a*, 37*b*, and 27) configured to support one or more sleeve segments (e.g., the sleeve segments 40 and/or 30).

As shown, the split collars 150 and 155 may comprise apertures 85 and 86, configured to permit drilling fluid circulation through the split collars. For example, the apertures 85 and 86 may comprise a plurality of bores regularly spaced around the circumference of the split collars 150 and 155.

Optionally, an outer radial surface of the split collars 150, 155, and/or 160 may comprise teeth configured to releasably engage corresponding teeth of a vertical makeup plate (not shown). Thus, the downhole tool and the sleeve assembly may be hanged at the top of the well, for example when rigging up the modules of the downhole tool and/or the sleeve assembly at the well site.

Figure 5:
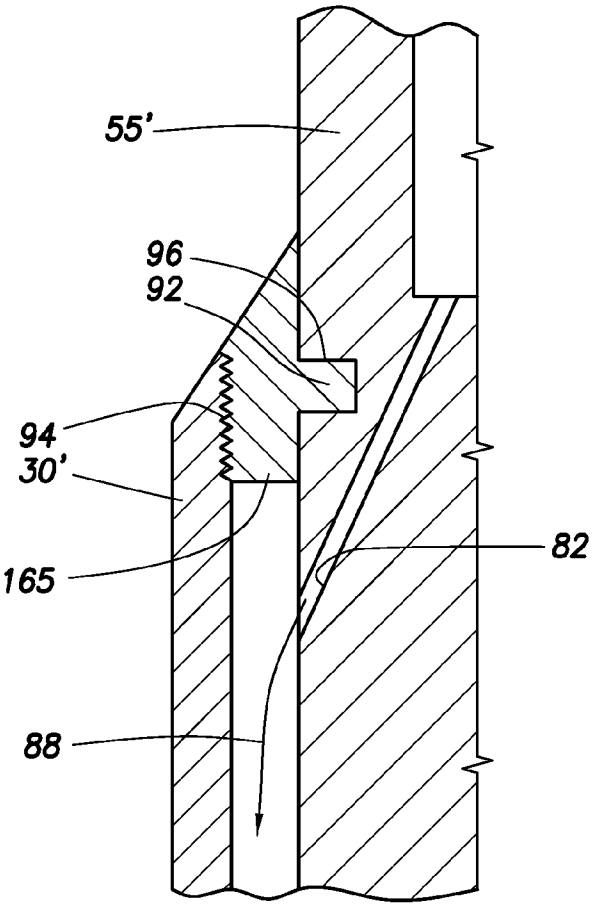
FIG. 5 is a sectional view of apparatus according to one or more aspects of the present disclosure.

FIG. 5 shows a half sectional view of another sleeve securing device according to one or more aspects of the present disclosure. The securing device may comprise a split threaded ring 165. The split threaded ring 165 may be used to implement the rings 25 and/or 45 shown in FIGS. 3A and 3B. The split threaded ring 165 may also be utilized to perform the step 110 of the method 100 shown in FIG. 2. For example, the split threaded ring 90 may be coupled to an outer surface of the body of a downhole tool (e.g., an outer surface of the body of a module 55') and a threaded end portion of a sleeve (e.g., a threaded end 94 of a sleeve segment 30').

The split threaded ring 165 may comprise two halves (not shown) configured to be mounted on an outer surface of the body of the downhole tool (e.g., the body of the well logging instrument 10 shown in FIGS. 3A-3B and/or a body of the module 55'). Two corresponding halves of one of the split threaded ring 165 may be clenched on the outer surface of the body of the downhole tool using a plurality of transverse bolts, among other assembly devices.

The split threaded ring 165 may comprise a projecting strip or tongue 92 configured to engage a corresponding slot 96 provided on an outer surface of the body of the downhole tool while permitting relative rotation between the split threaded ring 165 and the body of the module 55'. For example, the slot 96 may span over the entire perimeter of the body of the module 55'. Thus, to secure the sleeve segment 30' to the module 55', the split threaded ring 165 may be rotated and may connect to the threaded end portion 94 of the sleeve segment 30'.

The split threaded ring 165 and/or the sleeve segment 30' may be configured to deflect the flow of drilling mud escaping the vents 82' that would otherwise impinge on the wellbore wall, for example as shown by arrow 88. While the threaded ring 92 is shown located above circulation vents 82' of the module 55' and above the sleeve segment 55' in FIG. 5, the threaded ring 92 may alternatively be located below the circulation vents 82' of the module 55' and below the segment sleeve 30'. In these cases, drilling fluid escaping the circulation vents 82' may be deflected in the direction opposite of the direction shown by arrow 88.

Figure 6:
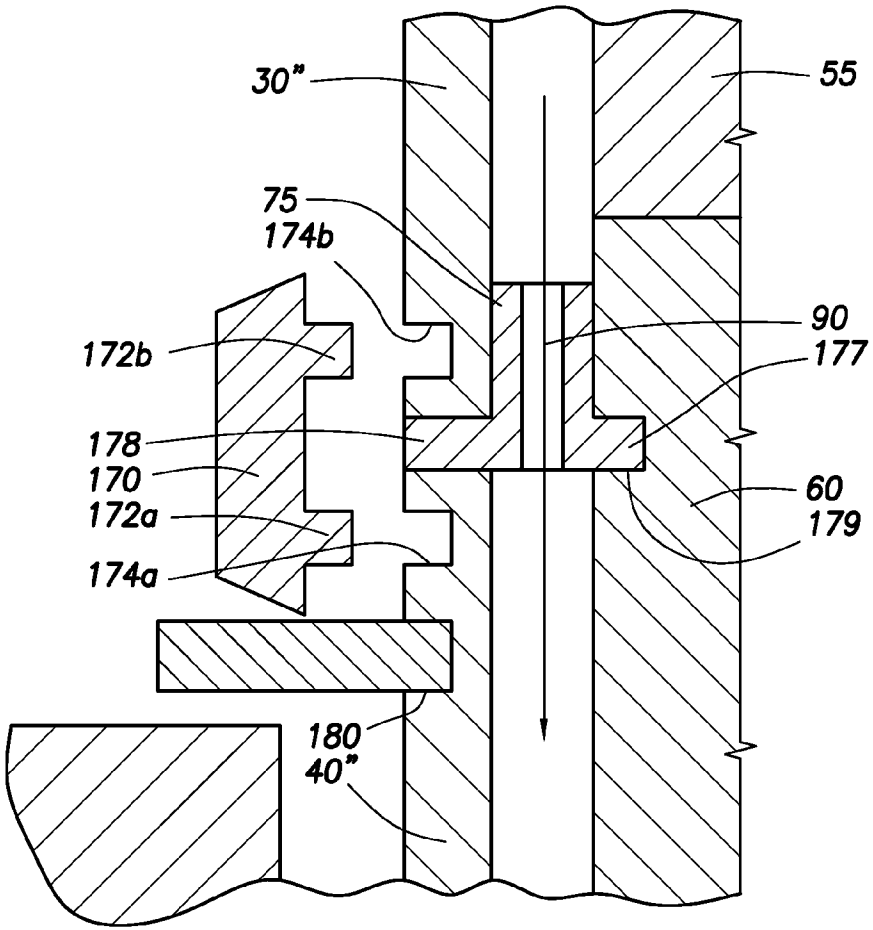
FIG. 6 is a sectional view of apparatus according to one or more aspects of the present disclosure.

FIG. 6 shows a half sectional view of yet another sleeve securing device according to one or more aspects of the present disclosure. The securing device may comprise a split bracing ring 170 and a split spacing ring 175. The split bracing ring 170 and the split spacing ring 175 may be used to implement the ring 35 shown in FIGS. 3A and 3B. The split bracing ring 170 and the split spacing ring 175 may also be utilized to perform the step 110 of the method 100 shown in FIG. 2. For example, the split spacing ring 175 may be engaged or coupled to an outer surface of the body of a downhole tool (e.g., an outer surface of the body of the module 60) and mate to ends of two sleeve segments (e.g., an upper end of sleeve segment 40" and a lower end of sleeve segment 30"). The bracing ring 170 may be engaged to an outer surface of the two sleeve segments (e.g., the sleeve segment 40" and the sleeve segment 30").

The split bracing ring 170 and/or the split spacing ring 175 may comprise two halves (not shown) configured to be mounted on an outer surface of the body of the downhole tool (e.g., the body of the well logging instrument 10 shown in FIGS. 3A-3B and/or a body of the module 60). Two corresponding halves of the split spacing ring 175 may be clenched on the outer surface of the body of the downhole tool using a plurality of transverse bolts, among other assembly devices. Two corresponding halves of the split bracing ring 170 may be clenched on the outer surface of the sleeve assembly (e.g., the sleeve segments 30" and 40") using a plurality of transverse bolts, among other assembly devices.

The split spacing ring 175 may comprise a projecting strip or tongue 177 configured to engage a corresponding slot 179 provided on an outer surface of the body of the downhole tool (e.g., the body of the well logging instrument 10 shown in FIGS. 3A-3B, and/or the body of the module 60). For example, the slot 179 may be provided by a vertical makeup groove usually utilized to hang wireline modules at the top of the well with a vertical makeup plate. The slot 179 may span over the entire perimeter of the body of the modules 60, or over a portion thereof. The split spacing ring 175 may comprise a shoulder 178 configured to mate to the upper and lower ends of the sleeve segments 40" and 30", respectively.

The split bracing ring 170 may comprise two or more projecting strip or tongue 172*a* and 172*b*, configured to engage corresponding slots 174*a* and 174*b* provided on an outer surface of segments of the sleeve assembly (e.g., the sleeve segment 40" and the sleeve segment 30", respectively).

Optionally, the sleeve segment 40" and/or the sleeve segment 30" may comprise a vertical makeup groove 180. The vertical makeup groove 180 may be utilized to hang the downhole tool at the top of the well with a vertical makeup plate, for example when rigging up the modules of the downhole tool and/or the sleeve assembly at the well site. Alternatively or additionally, an outer radial surface of the split bracing ring 170 may comprises teeth configured to releasably engage corresponding teeth of a vertical makeup plate.

Figure 7A:
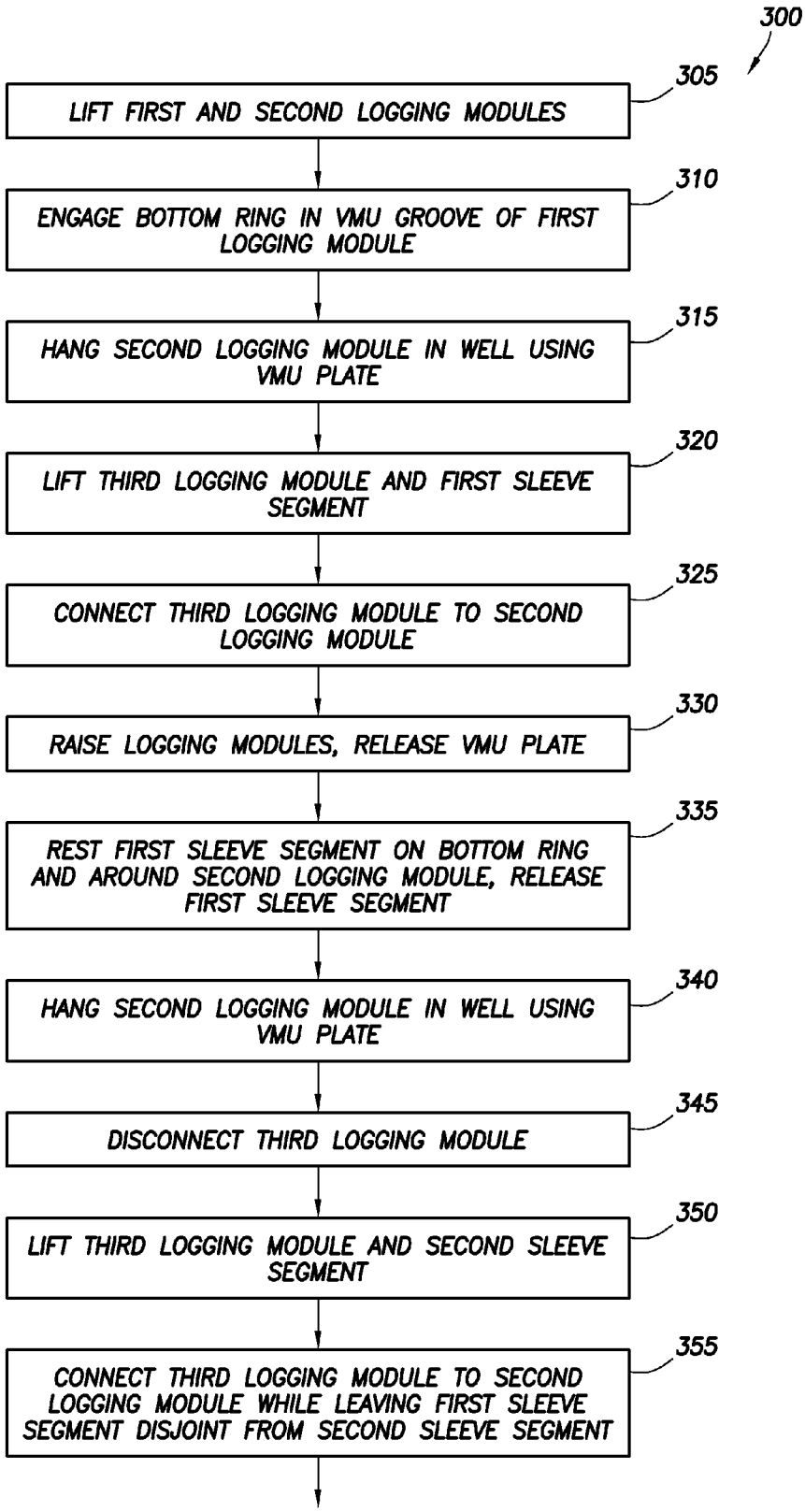
FIGS. 7A-7B is a flow-chart diagram of at least a portion of a method according to one or more aspects of the present disclosure.
Figure 7B:
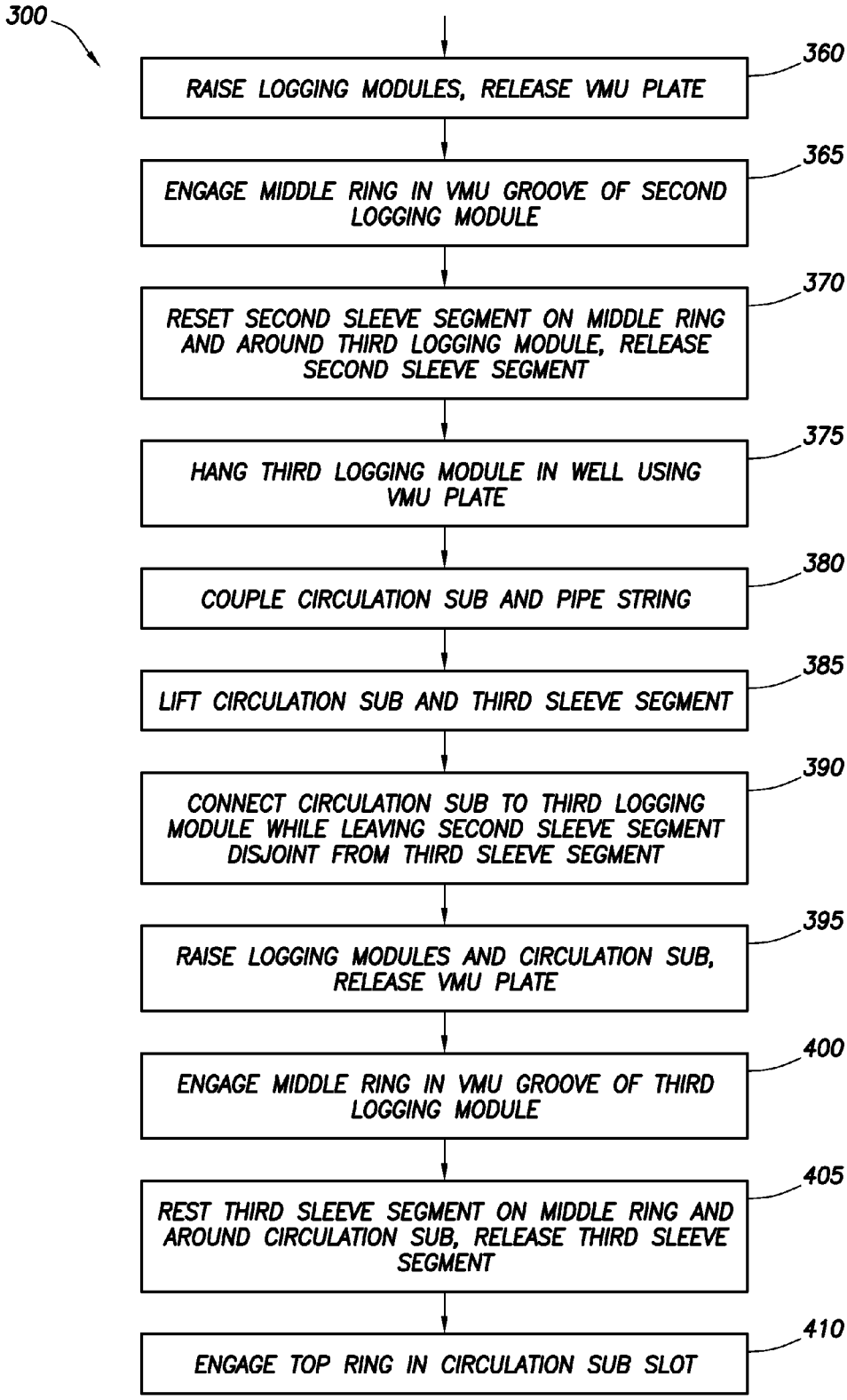

FIGS. 7A-7B show a method 300 of deploying a downhole tool (e.g., a wireline modular well logging instrument) and a sleeve assembly into a wellbore penetrating a subterranean formation. It should be appreciated that the order of execution of the steps depicted in the flow chart of FIGS. 7A-7B may be changed and/or some of the steps described may be combined, divided, rearranged, omitted, eliminated, repeated and/or implemented in other ways. For example, the method 300 may be used to secure less than or more than three sleeve segments around a well logging tool.

As shown, the method 300 may be performed at the well site. The method 300 may be performed using a downhole tool similar to the well logging instrument 10 shown in FIGS. 3A, and 3B. The method 300 may be used to implement one or more of steps 105, 110, 115, and 120 of the method 100 shown in FIG. 2. For the purpose of illustration, different stages of progressive deployment of the downhole tool according to one or more aspects of the method 300 and/or other methods disclosed herein are shown in FIGS. 8A-8J.

Figure 8A:
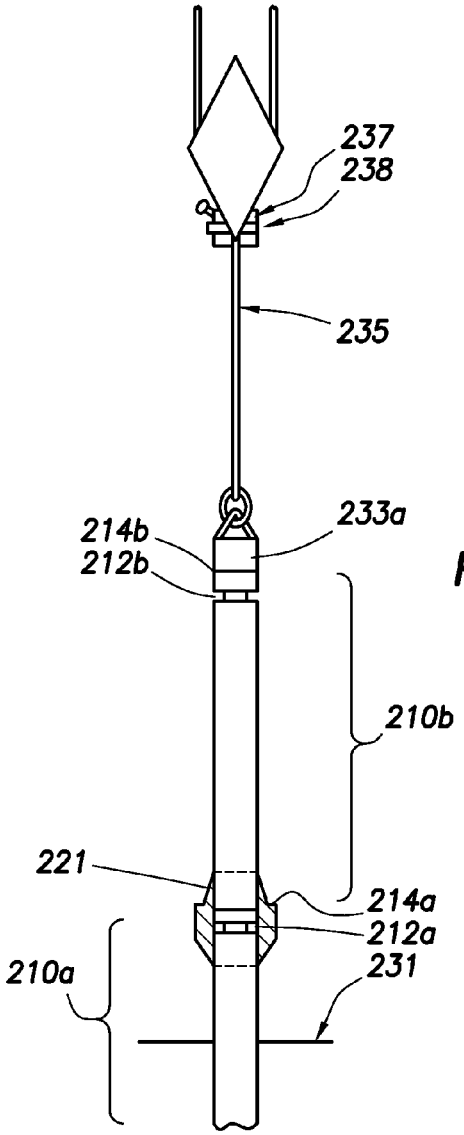
FIGS. 8A-8J are schematic views of an apparatus in different stages of progressive deployment according to one or more aspects of the present disclosure.

Referring collectively to FIG. 7A and FIG. 8A, a first module 210*a* (e.g., a formation tester) and a second module 210*b*, for examples modules of a wireline well logging instrument, may be lifted at step 305 at least partially above a rig floor 231 located at a well site. For example, the first and second modules 210*a* and 210*b* may be lifted using an elevator 237 comprising a travelling block associated with a crown block (not shown) mounted on a derrick (not shown). The travelling block may be linked to the first and second modules 210*a* and 210*b* via a "T bar" 238 having an extension link 235 configured to connect to a first tool lifting eye 233*a*. However, other lifting means may be used within the scope of the present disclosure.

At step 310, a bottom ring 221 may be engaged with an outer surface of a body of the first module 210*a*. For example, the bottom ring 221 may be of a type similar to the split collar ring 150 shown in FIG. 4A, or the split threaded ring 165 shown in FIG. 5. The first module 210*a* may comprise a vertical makeup (or "VMU") grooves 212*a* located proximate a module makeup joint 214*a*. The bottom ring 221 may be engaged into the vertical makeup groove 212*a* of the first module 210*a*.

Figure 8B:
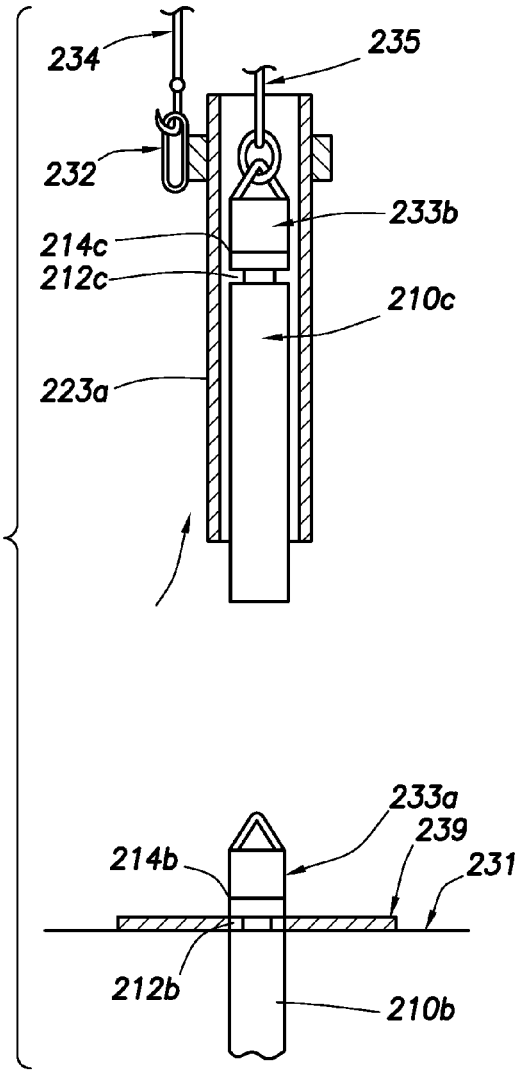

Referring collectively to FIG. 7A and FIG. 8B, the second module 210*b* may be hung at the top of the well and above the rig floor 231 at step 315. For example a vertical makeup plate 239 may be set into a vertical makeup groove 212*b* located proximate a module makeup joint 214*b* of the second module 210*b*.

At step 320, a third module 210*c* and a first sleeve segment 223*a* may be lifted. The third module 210*c* may be inserted into the first sleeve segment 223*a* while the first sleeve segment 223*a* is lying on the rig floor and both the third module 210*c* and the first sleeve segment 223*a* may be lifted contemporarily. Alternatively, the third module 210*c* may be first lifted, and then the third module 210*c* may be dressed with the first sleeve segment 223*a*. Still alternatively, the extension link 235 or another extension link such as a chain having and end configured to connect with the first lifting eye 233*a* may be dressed in place of the third module 210*c*. For example, the third module 210*c* may be lifted using the elevator 237 shown in FIG. 8A. In these cases, the extension link 235 may be connected to a second tool lifting eye 233*b* connected to the third module 210*c*. The first sleeve segment 223*a* may be lifted using an air tugger line 234 having a hook configured to catch prongs 232. The prongs 232 may in turn grip an upper portion of the fist sleeve segment 223*a*.

Figure 8C:
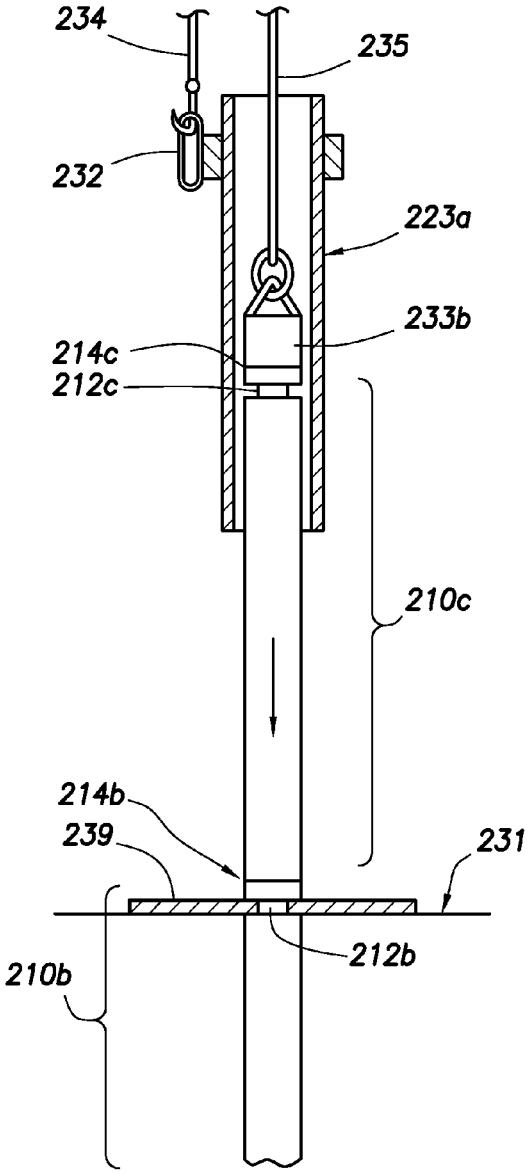

Referring collectively to FIG. 7A and FIG. 8C, the third module 210*c* may be connected to the second module 210*b* at step 325. For example, the first lifting eye 233*a* may be removed, thereby exposing a pin portion of the tool makeup joint 214*b*. Then, the third module 210*c* may be rigged up to the first and second modules 210*a* and 210*b*. In cases where the extension link 235 or another extension link is used in place of the third module 210*c*, the extension link 235 or the other extension link may alternatively be connected to the first lifting eye 233*a*.

Figure 8D:
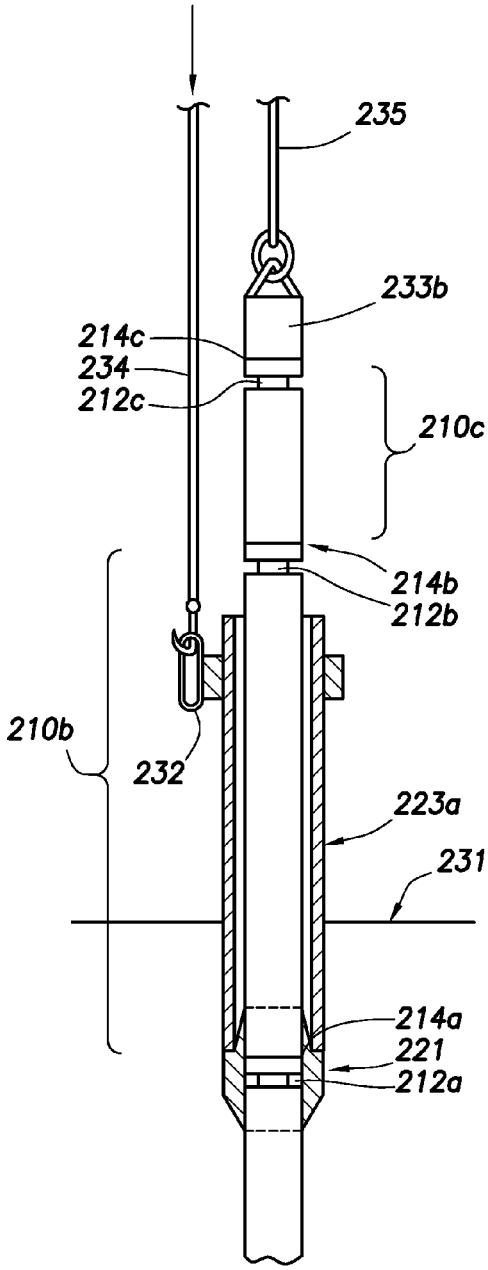

Referring collectively to FIG. 7A and FIG. 8D, the modules 210*a*, 210*b* and 210*c* may be raised and the vertical makeup plate 239 may be released or disengaged from the module 210*b* at step 330. Thus, the first sleeve segment 223*a* may be free to slide along the modules 210*b* and/or 210*a*.

The first sleeve segment 223*a* may be rested on a shoulder of the bottom ring 221 and around at least a portion of the second module 210*b* at step 335. For example, the modules 210*a*, 210*b* and 210*c* may be raised using the elevator 237 shown in FIG. 8A and/or the first sleeve segment 223*a* may be lowered using the air tugger line 234. Also, the prongs 232 may be released or disengaged from the first sleeve segment 223*a* at step 335.

Figures 8E, 8F:
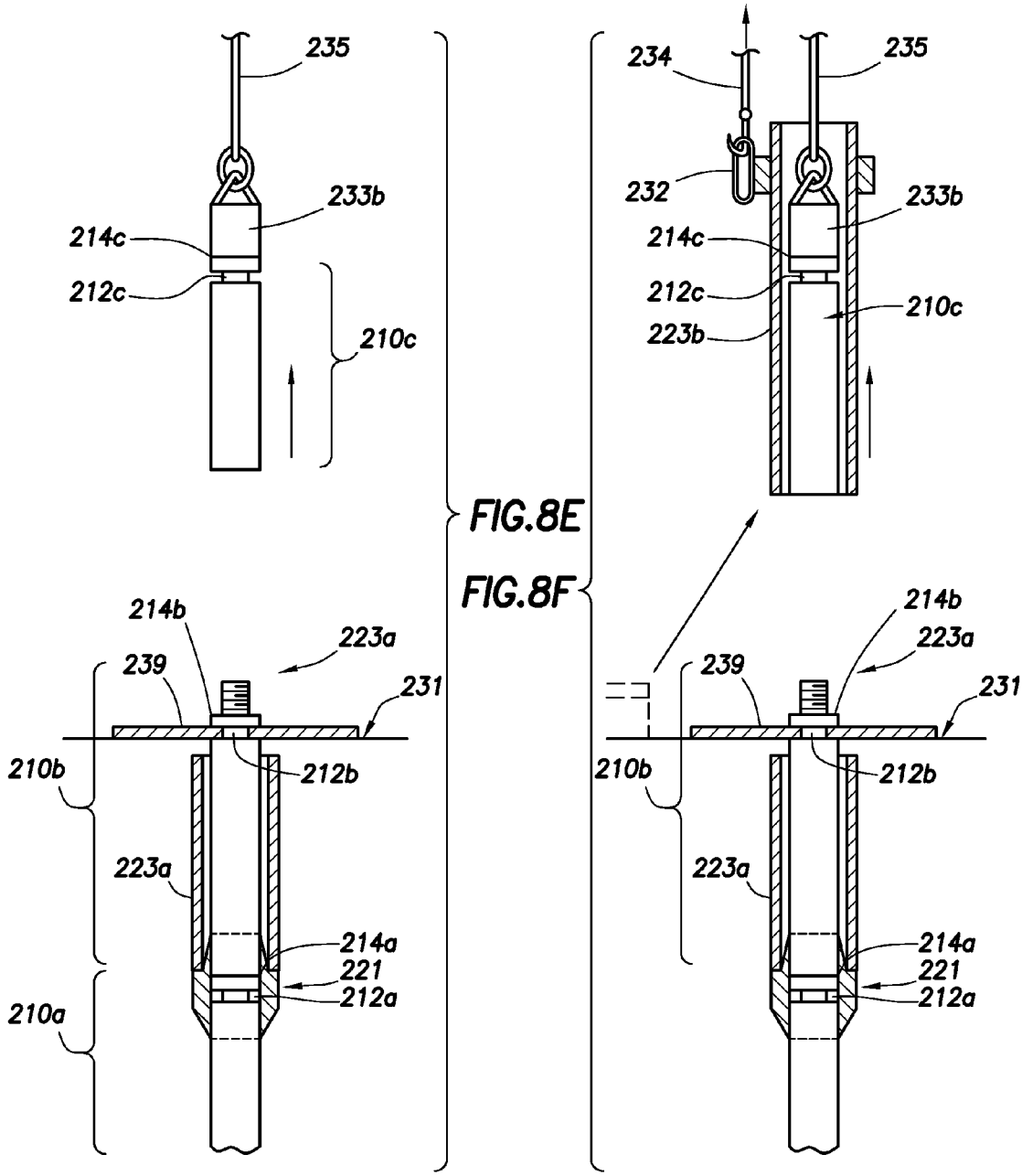

Referring collectively to FIG. 7A and FIG. 8E, the second module 210*b* may be hung at the top of the well at step 340, for example in a way similar to the description of step 315.

The third module 210*c* may be disconnected from the second module 210*b* at step 345. In cases where the extension link 235 or another extension link is used in place of the third module 210*c*, the extension link 235 or the other extension link may alternatively be disconnected from the first lifting eye 233*a*, and the first lifting eye 233*a* may be removed.

Referring collectively to FIG. 7A and FIG. 8F, the third module 210*c* and the second sleeve segment 223*b* may be lifted at step 350. For example, the prongs 232 may be used to grip an upper portion of the second sleeve segment 223*b*. The second sleeve segment 223*b* may be lifted using the air tugger line 234 and the prongs 232. Then, the third module 210*c* may be dressed with the second sleeve segment 223*b*. Alternatively, the third module 210*c* may be inserted into the second sleeve segment 223*b* while the second sleeve segment 223*b* is lying on the rig floor and both the third module 210*c* and the second sleeve segment 223*b* may be lifted contemporarily.

Figure 8G:
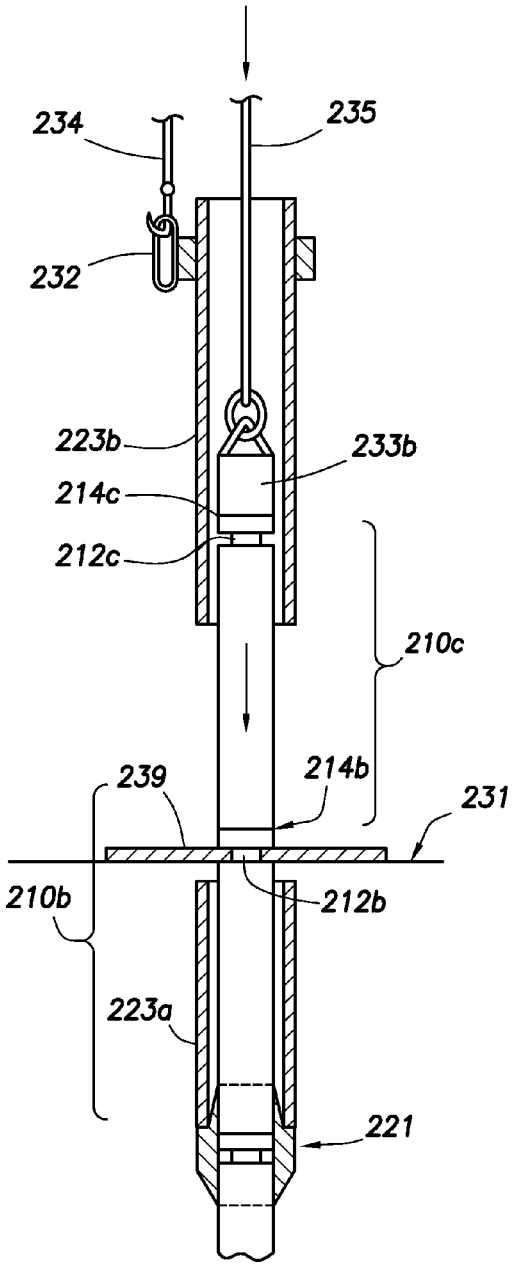

Referring collectively to FIG. 7A and FIG. 8G, the third module 210*c* may be connected to the second module 210*b* at step 355. For example, the third module 210*c* may be rigged up to the first and second modules 210*a* and 210*b* while leaving the first sleeve segment 223*a* disjoint from the second sleeve segment 223*b*.

Figure 8H:
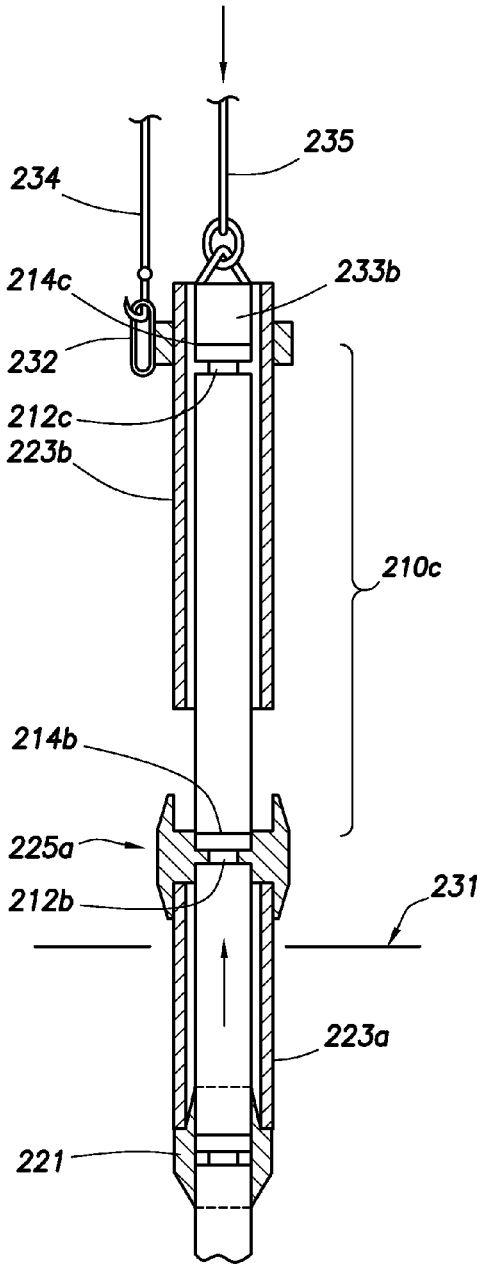

Referring collectively to FIG. 7B and FIG. 8H, the modules 810*a*, 810*b* and 810*c* may be raised and the vertical makeup plate 239 may be released or disengaged from the module 810*b* at step 360. Thus, the second sleeve segment 223*b* may be free to slide along the modules 810*c* and/or 810*b*.

At step 365, a middle ring 225*a* may be engaged with an outer surface of a body of the second module 210*b*. For example, the middle ring 225*a* may be of a type similar to the split collar ring 155 shown in FIG. 4B, or the combination of the split bracing ring 170 and the split spacing ring 175 shown in FIG. 6. The middle ring 225*a* may be engaged into the vertical makeup groove 212*b* of the first module 210*b*. The middle ring 225*a* may be used to support a top portion of the first sleeve segment 223*a*. Thus, the middle ring 225*a* and the bottom ring 221 may cooperate to secure the first sleeve segment 223*a* to the downhole tool.

The second sleeve segment 223*b* may be rested on a shoulder of the middle ring 225*a* and around at least a portion of the third module 210*c* at step 370 (not shown in FIG. 8H). For example, the modules 210*a*, 210*b* and 210*c* may be raised using the elevator 237 shown in FIG. 8A and/or the first sleeve segment 223*a* may be lowered using the air tugger line 234. Also, the prongs 232 may be released or disengaged from the second sleeve segment 223*b* at step 370 (not shown in FIG. 8H).

Figure 8I:
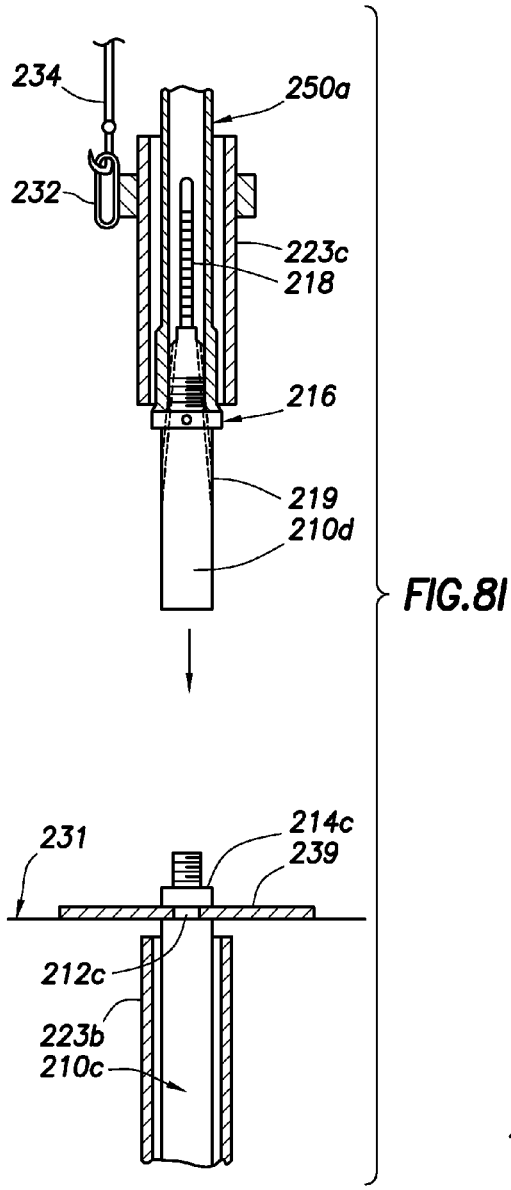

Referring collectively to FIG. 7B and FIG. 8I, the third module 210*c* may be hung at the top of the well and above the rig floor 231 at step 375. For example the vertical makeup plate 239 may be set into a vertical makeup groove 212*c* located proximate a module makeup joint 214*c* of the third module 210*c*.

At step 380, a module 210*d* (e.g., a circulation sub) may be connected to a first pipe segment 250*a*. For example, a clamp 216 may be affixed to the body of the module 210*d*. The clamp 216 may comprise a threaded pin connection configured to engage a corresponding box connection of the pipe segment 250*a*. Optionally, additional components, such as a compensated slip joint, may be inserted between the bottom end of the pipe segment 250*a* and the module 210*d* without departing from the scope of the present disclosure.

At step 385, the module 210*d* and a third sleeve segment 223*c* may be lifted. For example, the first pipe segment 250*a* may be lifted using the elevator 237 via a hook, a swivel and a kelly (not shown), or other means known in the art. The prongs 232 may be used to grip an upper portion of the third sleeve segment 223*c*. The third sleeve segment 223*c* may be lifted using the air tugger line 234 and the prongs 232. Then, the module 210*d* and/or the pipe segment 250 a may be dressed with the third sleeve segment 223*c*. Alternatively, the module 210*d* and a third sleeve segment 223*c* may be lifted contemporarily.

Referring collectively to FIG. 7B and FIG. 8I, the module 210*d* may be connected to the third module 210*c* at step 390. For example, the module 210*d* may be rigged up to the first, second, and third modules 210*a*, 210*b*, and 210*c* while leaving the second sleeve segment 223*b* disjoint from the third sleeve segment 223*c*.

At step 395, the modules 210*a*, 210*b* and 210*c* and the module 210*d* may be raised and the vertical makeup plate 239 may be released or disengaged from the module 810*c*. Thus, the third sleeve segment 223*c* may be free to slide along the modules 210*d* and/or 210*c*.

At step 400, a middle ring 225*b* may be engaged with an outer surface of a body of the third module 210*c*. For example, the middle ring 225*b* may be of a type similar to the split collar ring 155 shown in FIG. 4B, or the combination of the split bracing ring 170 and the split spacing ring 175 shown in FIG. 6. The middle ring 225*b* may be engaged into the vertical makeup groove 212*c* of the first module 210*c*. The middle ring 225*b* may be used to support a top portion of the second sleeve segment 223*b*. Thus, the middle ring 225*b* and the middle ring 225*a* may cooperate to secure the second sleeve segment 223*b* to the downhole tool.

At step 405, the third sleeve segment 223*c* may be rested on a shoulder of the middle ring 225*b* and around at least a portion of the module 210*d*. Also, the prongs 232 may be released or disengaged from the third sleeve segment 223*c* at step 405 (not shown in FIG. 8I).

At step 410, a top ring 227 may be engaged with an outer surface of a body of the module 210*d*. For example, the top ring 227 may be of a type similar to the top split collar 160 shown in FIG. 4C. The top ring 227 may comprise a slot configured to engage a corresponding projecting strip or tongue provided on an outer surface of the clamp 216. The top ring 227 may be used to support a top portion of the third sleeve segment 223*c*. Thus, the top ring 227 and the middle ring 225*b* may cooperate to secure the third sleeve segment 223*c* to the downhole tool. It should be noted that a top ring of a type similar to the split threaded ring 165 shown in FIG. 5 may alternatively be used at step 410.

The deployment of the downhole tool towards a subterranean formation penetrated by a wellbore may continue by adding pipe segments, such as pipe segment 205*b*.

As shown in FIG. 8I, the circulation sub 810*d* may comprise a wet connect 218 configured to latch with a logging head of a wireline cable pumped down to the tool string (e.g., the pipe elements 250*a*, 250*b*, among other pipe elements). Thus, the downhole tool (e.g., the modules 210*a*, 210*b*, 210*c*, and/or 210*d*) may be connected to a wireline cable.

Figure 8J:
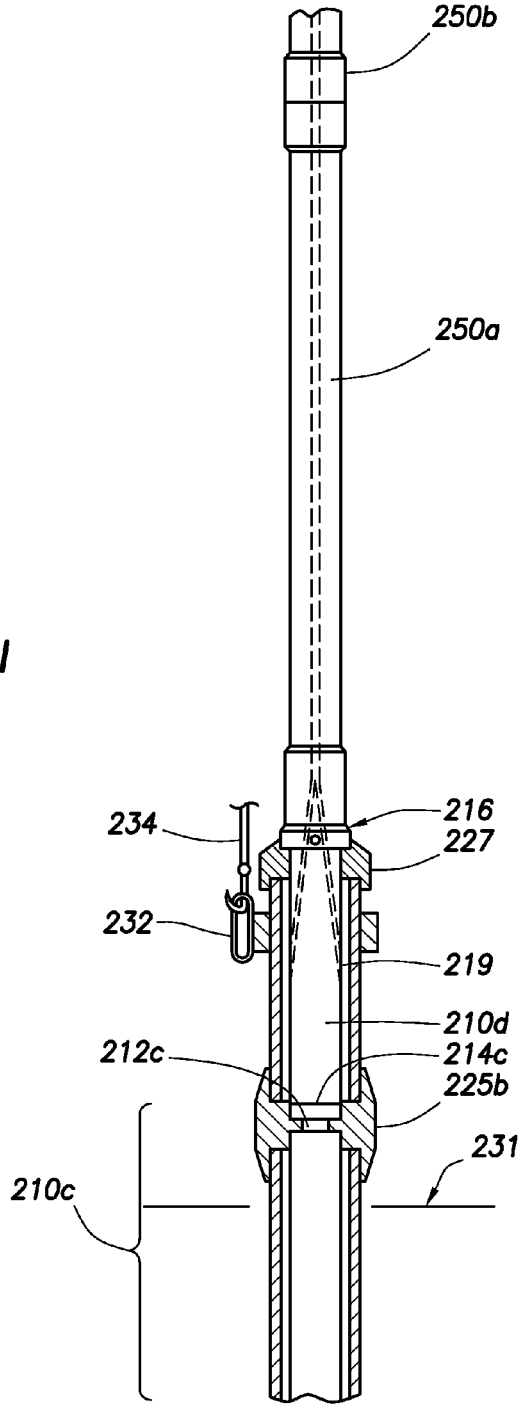

As readily apparent in FIG. 8J, the sleeve assembly comprising the sleeve segments 223*a*, 223*b*, and 223*c*, and interposed between the rings 221, 225*a*, 225*b* and 227 may form a flow passage between the downhole tool outer surface and the sleeve assembly. Thus, drilling fluid escaping from vents 219 provided with the module 210*d* may be circulated at least partially in the flow passage formed between the downhole tool outer surface and the sleeve assembly.

In view of all of the above and FIGS. 1 to 8, it should be readily apparent to those skilled in the art that the present disclosure provides a method comprising securing a sleeve around at least a portion of a wireline downhole tool, wherein securing the sleeve around the at least portion of the downhole tool is performed at the well site, coupling the wireline downhole tool to an end of a pipe string, deploying the sleeve and the wireline downhole tool into a wellbore penetrating a subterranean formation, and retrieving the sleeve and the wireline downhole tool from the wellbore. Securing the sleeve around the at least portion of the downhole tool may comprise interposing a sleeve segment between rings configured to engage an outer surface of the wireline downhole tool. Securing the sleeve around the at least portion of the downhole tool may comprise coupling at least one threaded ring with an outer surface of the wireline downhole tool and a threaded portion of the sleeve. The sleeve may comprise first and second sleeve segments, the downhole tool may comprise first and second modules, and the method may further comprise connecting the first module to the second module while leaving the first sleeve segment disjoint from the second sleeve segment. The sleeve may comprise first and second sleeve segments, and securing the sleeve around the at least portion of the downhole tool may comprise engaging a bracing ring to the first and second sleeve segments. The method may further comprise coupling the downhole tool to a wireline cable. The method may further comprise forming a flow passage between the downhole tool outer surface and the sleeve.

The present disclosure also provides a method comprising providing a downhole tool, interposing a sleeve between rings configured to engage an outer surface of the downhole tool, and deploying the downhole tool and the sleeve into a wellbore penetrating a subterranean formation. The sleeve may comprise first and second sleeve segments, the downhole tool may comprise first and second modules, and the method may further comprise connecting the first module to the second module while leaving the first sleeve segment disjoint from the second sleeve segment. Interposing the sleeve between rings may be performed at the well site. The method may further comprise coupling the tool string to an end of a pipe string. The method may further comprise coupling the downhole tool to a wireline cable. The method may further comprise forming a flow passage between the downhole tool outer surface and the sleeve. The method may further comprise retrieving the sleeve and the downhole tool from the wellbore. The sleeve may comprise first and second sleeve segments, and the method may further comprise engaging a bracing ring to the first and second sleeve segments. Providing the downhole tool may comprise providing a modular wireline well logging instrument.

The present disclosure also provides a method comprising providing a downhole tool, coupling at least one threaded ring with an outer surface of the downhole tool and a threaded portion of a sleeve, and deploying the downhole tool and the sleeve into a wellbore penetrating a subterranean formation. Coupling the at least one threaded ring with the outer surface of the downhole tool and the sleeve may be performed at the well site. The method may further comprise coupling the tool string to an end of a pipe string. The method may further comprise forming a flow passage between the downhole tool outer surface and the sleeve.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

securing a sleeve around at least a portion of a wireline downhole tool, wherein securing the sleeve around the at least portion of the downhole tool is performed at the well site;

coupling the wireline downhole tool to an end of a pipe string;

deploying the sleeve and the wireline downhole tool into a wellbore penetrating a subterranean formation; and retrieving the sleeve and the wireline downhole tool from the wellbore;

wherein securing the sleeve around the at least portion of the downhole tool comprises interposing a sleeve segment between rings configured to engage an outer surface of the wireline downhole tool.

2. The method of claim 1 wherein securing the sleeve around the at least portion of the downhole tool comprises coupling at least one threaded ring with an outer surface of the wireline downhole tool and a threaded portion of the sleeve.

3. The method of claim 1 wherein the sleeve comprises first and second sleeve segments, wherein the downhole tool comprises first and second modules, and further comprising connecting the first module to the second module while leaving the first sleeve segment disjoint from the second sleeve segment.

4. The method of claim 1 wherein the sleeve comprises first and second sleeve segments, and wherein securing the sleeve around the at least portion of the downhole tool comprises engaging a bracing ring to the first and second sleeve segments.

5. The method of claim 1 further comprising coupling the downhole tool to a wireline cable.

6. The method of claim 1 further comprising forming a flow passage between the downhole tool outer surface and the sleeve.

7. A method, comprising:

providing a downhole tool, wherein the downhole tool comprises first and second modules;

interposing a sleeve between rings configured to engage an outer surface of the downhole tool, wherein the sleeve comprises first and second sleeve segments;

connecting the first module to the second module while leaving the first sleeve segment disjoint from the second sleeve segment; and deploying the downhole tool and the sleeve into a wellbore penetrating a subterranean formation.

8. The method of claim 7 wherein interposing the sleeve between the rings is performed at the well site.

9. The method of claim 7 further comprising coupling the downhole tool to an end of a pipe string.

10. The method of claim 7 further comprising coupling the downhole tool to a wireline cable.

11. The method of claim 7 further comprising forming a flow passage between the downhole tool outer surface and the sleeve.

12. The method of claim 7 further comprising retrieving the sleeve and the downhole tool from the wellbore.

13. The method of claim 7 wherein the sleeve comprises first and second sleeve segments, and further comprising engaging a bracing ring to the first and second sleeve segments.

14. The method of claim 7 wherein providing the downhole tool comprises providing a modular wireline well logging instrument.

15. A method, comprising:

providing a downhole tool;

coupling at least one threaded ring with an outer surface of the downhole tool and a threaded portion of a sleeve, wherein coupling the at least one threaded ring with the outer surface of the downhole tool and the sleeve is performed at the well site; and deploying the downhole tool and the sleeve into a wellbore penetrating a subterranean formation.

16. The method of claim 15 further comprising coupling the downhole tool to an end of a pipe string.

17. The method of claim 15 further comprising forming a flow passage between the downhole tool outer surface and the sleeve.

18. A method, comprising:

securing a sleeve around at least a portion of a wireline downhole tool, wherein the sleeve comprises first and second sleeve segments, wherein the downhole tool comprises first and second modules, and wherein securing the sleeve around the at least portion of the downhole tool is performed at the well site;

connecting the first module to the second module while leaving the first sleeve segment disjoint from the second sleeve segment;

coupling the wireline downhole tool to an end of a pipe string;

deploying the sleeve and the wireline downhole tool into a wellbore penetrating a subterranean formation; and retrieving the sleeve and the wireline downhole tool from the wellbore.

19. The method of claim 18 wherein securing the sleeve around the at least portion of the downhole tool comprises coupling at least one threaded ring with an outer surface of the wireline downhole tool and a threaded portion of the sleeve.

20. The method of claim 18 wherein securing the sleeve around the at least portion of the downhole tool comprises engaging a bracing ring to the first and second sleeve segments.

21. The method of claim 18 further comprising coupling the downhole tool to a wireline cable.

22. The method of claim 18 further comprising forming a flow passage between the downhole tool outer surface and the sleeve.

23. A method, comprising:

providing a downhole tool;

interposing a sleeve between rings configured to engage an outer surface of the downhole tool;

deploying the downhole tool and the sleeve into a wellbore penetrating a subterranean formation; and retrieving the sleeve and the downhole tool from the wellbore.

24. The method of claim 23 wherein interposing the sleeve between the rings is performed at the well site.

25. The method of claim 23 further comprising coupling the tool string to an end of a pipe string.

26. The method of claim 23 further comprising coupling the downhole tool to a wireline cable.

27. The method of claim 23 further comprising forming a flow passage between the downhole tool outer surface and the sleeve.

28. The method of claim 23 wherein the sleeve comprises first and second sleeve segments, and further comprising engaging a bracing ring to the first and second sleeve segments.

29. The method of claim 23 wherein providing the downhole tool comprises providing a modular wireline well logging instrument.

30. A method, comprising:

providing a downhole tool;

interposing a sleeve between rings configured to engage an outer surface of the downhole tool, wherein the sleeve comprises first and second sleeve segments;

engaging a bracing ring to the first and second sleeve segments; and deploying the downhole tool and the sleeve into a wellbore penetrating a subterranean formation.

31. The method of claim 30 wherein interposing the sleeve between the rings is performed at the well site.

32. The method of claim 30 further comprising coupling the tool string to an end of a pipe string.

33. The method of claim 30 further comprising coupling the downhole tool to a wireline cable.

34. The method of claim 30 further comprising forming a flow passage between the downhole tool outer surface and the sleeve.

35. The method of claim 30 further comprising retrieving the sleeve and the downhole tool from the wellbore.

36. The method of claim 30 wherein providing the downhole tool comprises providing a modular wireline well logging instrument.

37. A method, comprising:

providing a downhole tool, wherein providing the downhole tool comprises providing a modular wireline well logging instrument;

interposing a sleeve between rings configured to engage an outer surface of the downhole tool; and deploying the downhole tool and the sleeve into a wellbore penetrating a subterranean formation.

38. The method of claim 37 wherein interposing the sleeve between the rings is performed at the well site.

39. The method of claim 37 further comprising coupling the tool string to an end of a pipe string.

40. The method of claim 37 further comprising coupling the downhole tool to a wireline cable.

41. The method of claim 37 further comprising forming a flow passage between the downhole tool outer surface and the sleeve.

42. The method of claim 37 further comprising retrieving the sleeve and the downhole tool from the wellbore.

43. The method of claim 37 wherein the sleeve comprises first and second sleeve segments, and further comprising engaging a bracing ring to the first and second sleeve segments.

* * * * *